US008190334B2

(12) United States Patent
Kagoshima et al.

(10) Patent No.: US 8,190,334 B2
(45) Date of Patent: May 29, 2012

(54) ROTATION CONTROL DEVICE AND WORKING MACHINE THEREWITH

(75) Inventors: Masayuki Kagoshima, Hiroshima (JP); Akira Tsutsui, Kobe (JP); Masayuki Komiyama, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 1135 days.

(21) Appl. No.: 12/034,331

(22) Filed: Feb. 20, 2008

(65) Prior Publication Data

US 2008/0201045 A1 Aug. 21, 2008

(30) Foreign Application Priority Data

Feb. 21, 2007 (JP) ..... 2007-041381
Aug. 28, 2007 (JP) ..... 2007-221182
Aug. 28, 2007 (JP) ..... 2007-221183

(51) Int. Cl.
*A01B 63/00* (2006.01)

(52) U.S. Cl. ..... 701/50; 37/348

(58) Field of Classification Search ..... 37/347, 37/348; 172/2–11; 414/699–724; 701/50; 318/372, 461, 799, 822, 823, 151, 114, 801; 417/12, 34, 25, 42, 44.1
See application file for complete search history.

(56) References Cited

U.S. PATENT DOCUMENTS 5,967,758 A * 10/1999 Fujii et al. ..... 417/34
6,646,394 B2 * 11/2003 Minagawa et al. ..... 318/151
7,067,999 B2 * 6/2006 Sugano et al. ..... 318/372
2005/0253542 A1 11/2005 Sugano et al.

FOREIGN PATENT DOCUMENTS

JP 8-175791 7/1996
JP 9-189302 7/1997
JP 9-242708 9/1997
JP 10-310374 11/1998
JP 11-230108 8/1999
JP 2001-10783 1/2001
JP 2003-328398 11/2003
JP 2003-333876 11/2003
(Continued)

OTHER PUBLICATIONS

Office Action issued Jun. 28, 2011, in Japanese Patent Application No. 2007-221182 (with English-language translation).

*Primary Examiner* — Robert Pezzuto
(74) *Attorney, Agent, or Firm* — Oblon, Spivak, McClelland, Maier & Neustadt, L.L.P.

(57) ABSTRACT

An excavator has a controller capable of setting target torque of a rotation motor in accordance with a speed deviation between target speed set in accordance with an operation amount of an operating lever and actual rotation speed and is provided with an inverter for detecting necessary torque for rotating an upper rotating body, the necessary torque being changed in accordance with a working state of the upper rotating body. The controller calculates a correction amount which is increased as increasing the torque and subtracts the correction amount from the target speed so as to set new target speed. A controller sets first target torque for driving the motor and second target torque for maintaining the upper rotating body on the spot on the basis of the actual speed, and operates the motor in accordance with the torque which has a larger absolute value in the same direction as the first target torque among both the torque.

9 Claims, 13 Drawing Sheets

FOREIGN PATENT DOCUMENTS

| | | |
|---|---|---|
| JP | 2004-36303 | 2/2004 |
| JP | 2004-137702 | 5/2004 |
| JP | 2005-273262 | 10/2005 |
| JP | 2005-290902 | 10/2005 |
| WO | WO 2005/111321 A1 | 11/2005 |
| WO | WO 2005/111322 A1 | 11/2005 |
| WO | WO 2006/054581 A1 | 5/2006 |
| WO | WO 2006/054582 A1 | 5/2006 |

* cited by examiner

ROTATION CONTROL DEVICE AND WORKING MACHINE THEREWITH

BACKGROUND OF THE INVENTION

1. Field of the Invention

The present invention relates to a rotation control device of working machine for rotating and driving a rotating body by an electric motor.

2. Description of the Related Art

In a rotation working machine such as an excavator and a crane, a hydraulic motor driven by discharge oil of a hydraulic pump serves as a driving source of a rotating body. However, in recent years, there is a known technique that the driving source is an electric motor (for example, Japanese Patent Laid-Open No. 2001-10783, hereinafter referred to as Patent Document 1).

In such a case, due to speed control for determining a torque instruction with using a deviation between target speed set in accordance with an operation amount of a rotation operating lever and actual rotation speed (what is called speed feedback control), when the above deviation is increased, acceleration torque is radically increased and shock is generated.

Meanwhile, there is a known technique that while PID control is performed, torque restriction is added in accordance with the operation amount as in Japanese Patent Laid-Open No. 2004-36303 (hereinafter, referred to as Patent Document 2), and there is another known technique that with using a jerk probable value calculated by second-order differential of the target speed, the target speed is corrected as in Japanese Patent Laid-Open No. 2004-137702 (hereinafter, referred to as Patent Document 3).

Further, in order to prevent the generation of the shock, there is a known technique that a dynamic characteristic of the electric motor imitates a drive characteristic of a hydraulic motor as in Japanese Patent Laid-Open No. 2003-333876 (hereinafter, referred to Patent Document 4).

However, the techniques of Patent Documents 2 to 4 are to control rotating and driving on the basis of only the operation amount of the rotation lever, and therefore not capable of suppressing effectively the generation of the shock in an actual machine.

That is, in the actual working machine, even when the operation amount of the lever is constant, necessary torque for rotating a rotating body is changed in accordance with a working state thereof (such as a working state of a working attachment and an inclination angle of the working machine itself). Therefore, the working machine has a characteristic that the speed deviation is radically changed in accordance with an amount of the torque.

Therefore, in the techniques according to Patent Documents 2 to 4, with a large amount of the necessary torque, the speed deviation is increased despite of a small operation amount of the lever by an operator, and as a result, there is a fear that the torque given to the electric motor is increased so as to generate the shock.

In the speed feedback control, in order to improve a following property to the speed, in the case of the PID control for example, gain is increased to as a large amount as possible. However, in the case where the gain is increased, the deviation between the target speed and the actual rotation speed is small but instruction torque to the electric motor is excessively increased by a small amount of the lever operation. Therefore, in the case where a rotation pressing work by a bucket is performed, there is sometimes a case where adjustment of the pressing force is difficult. Further, in the case where a radical lever operation is performed, there is sometimes a case where the instruction torque to the electric motor is radically increased so as to generate the shock.

Conversely, in order to facilitate the adjustment of the instruction torque to the electric motor by the lever operation, in the case of the PID control for example, there is sometimes a case where the gain is decreased or integral gain is made to be zero. However, in the case where the gain is decreased, in a working state in an inclined ground (a state of receiving weight of the working machine itself) and the like, the instruction torque to the electric motor is excessively decreased so that it is not possible to ensure sufficient acceleration/deceleration torque and spot-maintenance torque.

As a technique for solving the problem of the speed feedback control, there are known techniques disclosed in Patent Documents 2, 5 to 7. The techniques are to properly switch between the two control systems mentioned above.

Specifically, Patent Document 5 (Japanese Patent Laid-Open No. 2003-328398) discloses a technique of switching between the speed feedback control and torque control taking a fixed operation amount of the operating lever as a border. Patent Document 6 (International Publication No. 2005/111322) discloses a technique of switching between speed control and position control taking a speed threshold value of the target speed in accordance with the operation amount of the lever as a border. Patent Document 7 (Japanese Patent Laid-Open No. 2005-273262) discloses a technique of switching between normal speed control and speed control with proportional gain which is more decreased than the above speed control taking predetermined speed of the rotating body as a border.

Patent Document 2 discloses a technique of performing position maintenance control when the operation amount of the operating lever is in a neutral range which is preliminarily set, while performing the torque control when the operation amount exceeds the neutral range.

However, in the case where the two control systems are switched as in Patent Documents mentioned above, at a point of switching between the control systems, the torque is discontinuously changed (radically changed) in order to fill a gap between the control systems so that it is not possible to smoothly and stably perform the control.

In the technique of Patent Document 2, in a state after the operation amount of the lever exceeds the neutral range, rotating and driving are performed with larger torque among the spot-maintenance torque and the acceleration torque. However, the spot-maintenance torque is torque which is generated in the position maintenance control executed within the neutral range and hence required in the past, and therefore not torque which reflects the working state at the present. Therefore, when the torque for maintaining the rotating body on the spot is larger at the time of executing the torque control than at the time of executing the position maintenance control, there is a fear that the rotating body is adversely moved against intention of the operator.

SUMMARY OF THE INVENTION

It is an object of the present invention to provide a rotation control device capable of suppressing generation of shock and a working machine therewith, and further a rotation control device of working machine capable of suppressing a discontinuous change of torque while preventing adverse movement of a rotating body and a working machine therewith.

The present invention is a rotation control device installed in a working machine having a main body, a rotating body rotatably mounted on the main body and a working attachment provided in the rotating body so as to be raised and lowered, comprising an electric motor for rotating and driving the rotating body, operation means for receiving an input operation of a drive instruction to the electric motor, operation amount detection means for detecting an operation amount of the operation means, speed detection means for detecting rotation speed of the electric motor, and control means for setting target speed of the electric motor on the basis of the operation amount detected by the operation amount detection means, setting target torque on the basis of a speed deviation between the target speed and the speed detected by the speed detection means, and operating the electric motor in accordance with the target torque, wherein the control means is provided with correction means for calculating a correction amount which is increased as increasing necessary torque for rotating the rotating body, the necessary torque being changed in accordance with a working state of the rotating body, and subtracting the correction amount from the target speed so as to make new target speed.

According to the present invention, an amount of the target torque of the electric motor is adjusted in accordance with the necessary torque for rotating the rotating body, the necessary torque being changed in accordance with the working state of the rotating body. Therefore, it is possible to effectively suppress the generation of the shock.

That is, in the working machine according to the present invention, in accordance with a working state thereof such as a working state of the working attachment (a working radius of the working attachment, existence or nonexistence of earth and sand within a bucket at the time of working or the like), or an external force received at the time of working (a reaction force received at the time of a pressing work by the bucket, weight of the working machine itself in a inclined ground or the like), the necessary torque for rotating the rotating body is changed. Therefore, as the necessary torque is increased, the speed deviation between the target speed and the actual speed detected by the speed detection means tends to be increased. However, since the correction means is provided in the control means of the present invention, it is possible to prevent the increase in the speed deviation.

The correction means is preferably formed so as to calculate the correction amount which is increased as increasing the necessary torque and subtract the correction amount from the target speed which is already set. It is possible to decrease the speed deviation between the new target speed and the actual speed detected by the speed detection means.

In such a case, as the necessary torque is increased, the speed deviation is decreased. As a result, it is also possible to decrease a value of the target torque given to the electric motor in order to fill the speed deviation. Therefore, it is possible to suppress the generation of the shock.

In the above rotation control device, the correction means preferably calculates a correction amount which is decreased as increasing the operation amount of the operation means.

In such a case, it is possible to suppress an excessive decrease in the target speed after correction as the operation amount of the operation means is increased. Therefore, it is possible to ease an uncomfortable feeling of an operator.

In the above rotation control device, the control means is formed so as to set the target torque for a predetermined cycle, and the correction means is preferably formed so as to utilize the target torque set in the previous cycle as a correspondent to the necessary torque of the rotating body to be used for the present cycle, and calculate the correction amount.

In such a case, it is possible to utilize the target torque set in the previous cycle as it is, and calculate the correction amount. Therefore, it is possible to simplify processing in comparison to the case where the necessary torque of the rotating body is actually calculated.

That is, all the change of the necessary torque is reflected to load torque of the electric motor. Therefore, by calculating the correction value in accordance with an increase/decrease in the load torque so as to calculate the target torque, it is possible to calculate the target torque corresponding to the change of the necessary torque.

The present invention is to provide a rotation control device installed in a working machine having a main body, a rotating body rotatably mounted on the main body and a working attachment provided in the rotating body so as to be raised and lowered, comprising an electric motor for rotating and driving the rotating body, operation means for receiving an input operation of a drive instruction to the electric motor, operation amount detection means for detecting an operation amount of the operation means, speed detection means for detecting rotation speed of the electric motor, and control means for setting first target torque for driving the electric motor at target speed corresponding to the operation amount detected by the operation amount detection means, setting second target torque for maintaining the rotating body on the spot on the basis of actual speed detected by the speed detection means, and operating the electric motor in accordance with torque which has a larger absolute value in the same direction as the first target torque among the first target torque and the second target torque.

According to the present invention, on the basis of the actual speed detected by the speed detection means, the second target torque is set. Therefore, even in the case where a work is performed in an environment in which the working state is changed each time, it is possible to specify spot-maintenance torque (second target torque) which is suitable for the working state at the present. That is, in accordance with the working state of the working attachment (the working radius of the working attachment, the existence or the nonexistence of the earth and sand within the bucket at the time of working or the like), the external force received at the time of working (the external force received at the time of the pressing work by the bucket, the weight of the working machine itself in the inclined ground or the like) or the like, the spot-maintenance torque is changed each time. However, according to the present invention, it is possible to surely prevent the adverse movement of the rotating body even in such a case.

Further, in the present invention, the larger value is selected between the second target torque calculated as above and the first target torque calculated on the basis of the operation amount of the operation means. Therefore, when examining transitioning lines of the first target torque and the second target torque (refer to FIG. 13), the torque to be selected is changed taking an intersection point of the lines (L8 in FIG. 13B) as a border. As mentioned above, according to the present invention, unlike the related art in which control systems are switched taking a specific element other than the torque as a border, the first target torque and the second target torque are always compared to each other in terms of an amount thereof so as to adopt the larger torque. Therefore, it is possible to suppress the discontinuous change of the torque.

Here, the control means is preferably provided with target speed setting means for setting the target speed on the basis of the operation amount detected by the operation amount detection means, first torque calculation means for calculating the first target torque on the basis of a speed deviation between the target speed and actual speed detected by the speed detection means, and target torque setting means for setting the torque which has a larger absolute value in the same direction as the first target torque among the first target torque and the second target torque as the next target torque.

Further, the control means is preferably provided with second torque calculation means for calculating torque to be given to the electric motor in order to make the actual speed zero as the second target torque.

It should be noted that "zero" not only indicates the case where the speed is just zero, but also includes a speed component within a range capable of determining that the speed is substantially zero.

The first torque calculation means and the second torque calculation means are adapted to calculate the first target torque and the second target torque on the basis of expressions having a proportional term and an integral term respectively, and the control means is preferably provided with further gain change means capable of changing an amount of gain by which the proportional term and the integral term are multiplied.

In such a case, it is possible to adjust the gain in proportional and integral control by the gain change means. Therefore, when the working radius of the working attachment is large and when the inertia moment of the rotating body is large as in the work in the inclined ground or the like, it is possible to surely prevent the adverse movement by changing the gain into larger gain. Meanwhile, in the case where the rotation pressing work by the bucket or the like is performed, it is possible to fine-adjust the torque in accordance with an operation of the operation means by changing the gain into smaller gain.

The present invention with the above configuration is to provide a working machine, comprising a main body, a rotating body rotatably mounted on the main body, and the above rotation control device.

BRIEF DESCRIPTION OF THE DRAWINGS

FIG. 12A shows torque transition of speed proportional control and transition of spot-maintenance torque; and FIG. 12B shows a state that the speed proportional control is switched to torque control; FIG. 13A shows torque transition of speed proportional control and transition of spot-maintenance torque; and FIG. 13B shows a state that the speed proportional control is switched to torque control.

DESCRIPTION OF THE PREFERRED EMBODIMENTS

Hereinafter, a description will be given to a preferred embodiment of the present invention with reference to the drawings.

Figure 1:
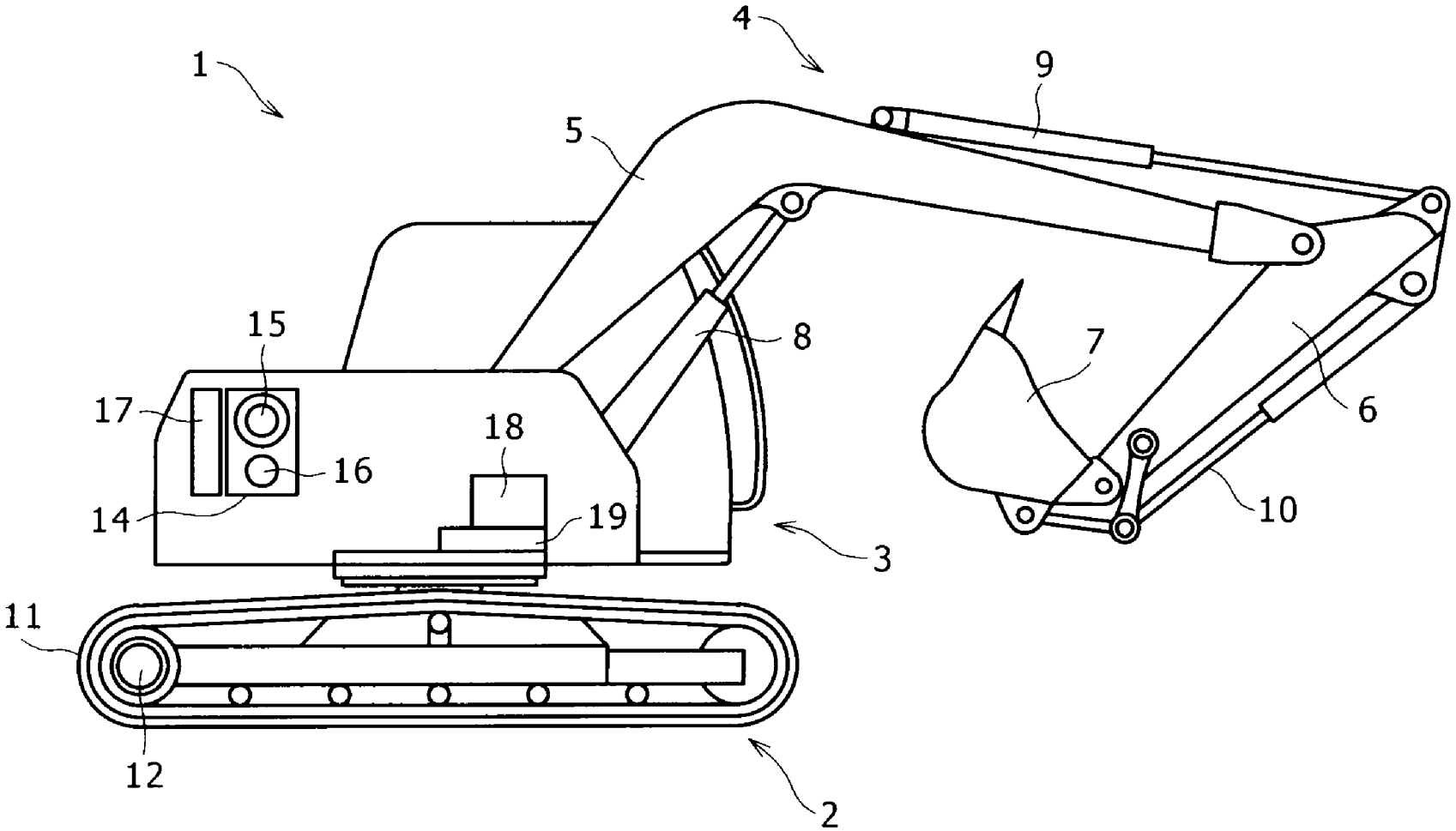
FIG. 1 is a side view showing an entire configuration of an excavator according to an embodiment of the present invention.
Figure 2:
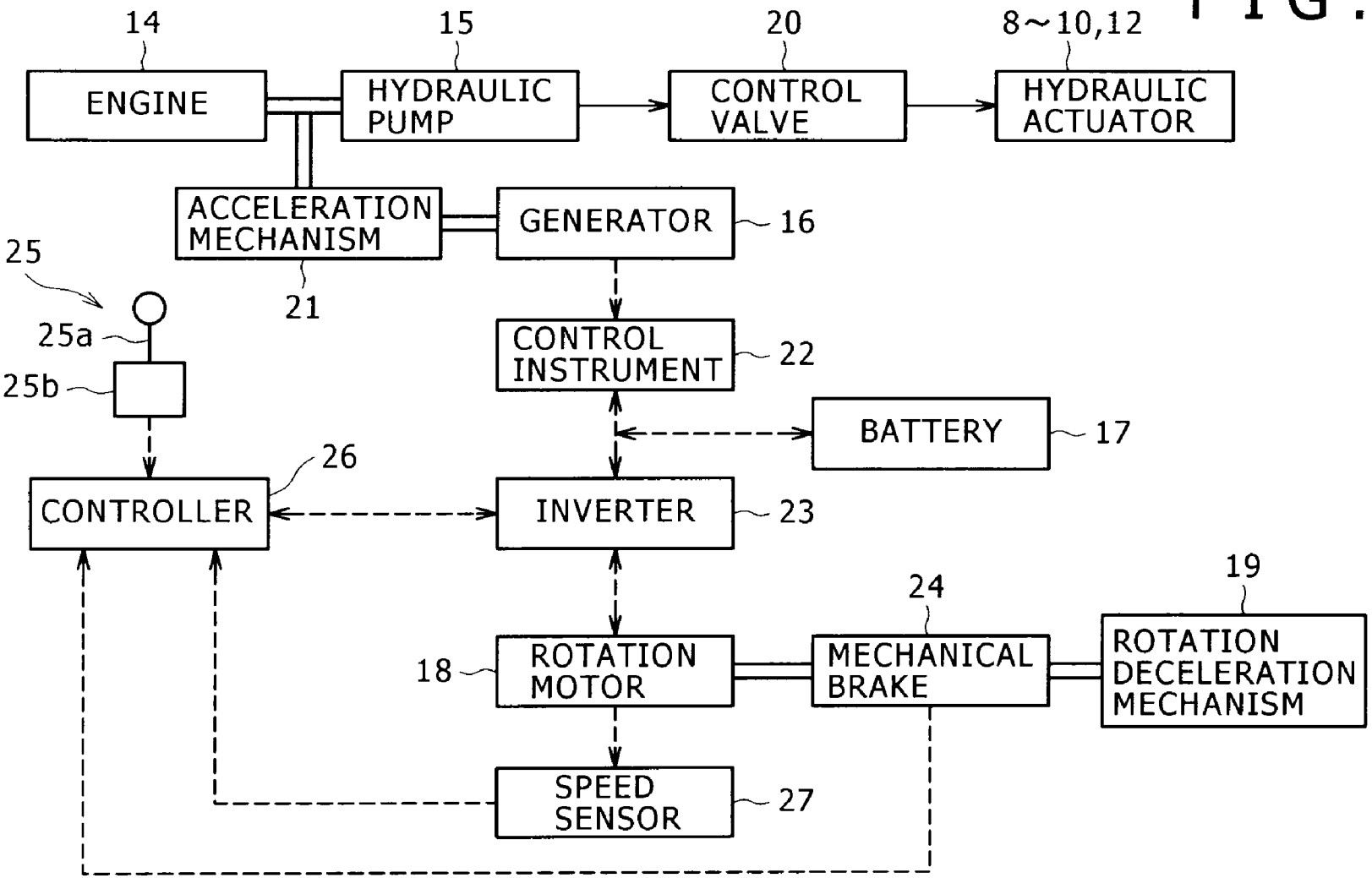
FIG. 2 is a block diagram showing a configuration of a drive and control system for the excavator in FIG. 1.

FIG. 1 shows a side view showing an entire configuration of an excavator according to an embodiment of the present invention. FIG. 2 is a block diagram showing a configuration of a drive and control system for the excavator in FIG. 1.

Referring to FIGS. 1 and 2, an excavator 1 serving as an example of a working machine is provided with a crawler type lower traveling body 2 (main body), an upper rotating body 3 rotatably mounted on the lower traveling body 2 (main body), and a working attachment 4 installed in a front section of the upper rotating body 3.

The working attachment 4 is provided with a boom 5 installed in the upper rotating body 3 so as to be raised and lowered, an arm 6 connected to a front end of the boom 5, a bucket 7 connected to a front end of the arm 6, a boom cylinder 8 for driving the boom 5 to the upper rotating body 3, an arm cylinder 9 for driving the arm 6 to the boom 5, and a bucket cylinder 10 for driving the bucket 7 to the arm 6.

The lower traveling body 2 is provided with a pair of left and right crawlers 11 (one of the crawlers is shown in FIG. 1). In the crawlers 11, traveling motors 12 are respectively provided.

The upper rotating body 3 is provided with an engine 14, a hydraulic pump 15 and a generator 16 driven by the engine 14, a battery 17, a rotation motor 18, and a deceleration mechanism 19 of the rotation motor 18.

As shown in FIG. 2, the hydraulic pump 15 supplies working oil to the boom cylinder 8, the arm cylinder 9, the bucket cylinder 10 and the traveling motors 12 (hereinafter, collectively referred to as the hydraulic actuators 8 to 10 and 12) through a control valve 20. In other words, by adjusting a flow rate of the working oil or the like from the hydraulic pump 15 to the hydraulic actuators 8 to 10 and 12 in accordance with an operation of the control valve 20, an action of the hydraulic actuators 8 to 10 and 12 is controlled.

The generator 16 is connected to an output shaft of the engine 14 through an acceleration mechanism 21. Electric power obtained by the generator 16 is charged in the battery 17 through a control instrument 22, and supplied to the rotation motor 18 through an inverter 23. It should be noted that the control instrument 22 is to adjust voltage application and supply of electric current.

The rotation motor 18 is provided with a mechanical brake 24 serving as a negative brake for generating a mechanical brake power. In a state that the mechanical brake 24 is released, since a drive force of the rotation motor 18 is transmitted to the lower traveling body 2 via the rotation deceleration mechanism 19, the upper rotating body 3 is rotated rightwards or leftwards to the lower traveling body 2.

The upper rotating body 3 is provided with an operating lever (rotation operating lever) 25. The operating lever 25 is provided with a lever portion 25*a* capable of tiltingly operating leftwards and rightwards from a neutral position which is preliminarily set, and an operation portion (such as a potentiometer) 25*b* for detecting an operation amount of the lever portion 25*a*. The operating lever 25 outputs an electric signal in accordance with the operation amount of the lever portion 25*a* to a controller 26 serving as an example of control means.

Further, the upper rotating body 3 is provided with a speed sensor 27 for detecting rotation speed of the rotation motor 18. The speed sensor 27 outputs an electric signal in accordance with the rotation speed of the rotation motor 18 to the controller 26.

The controller 26 is known control means including a CPU for executing various calculation processing, and a ROM for storing an initial setting and the like, a RAM for rewritably storing various information and the like. In the controller 26, a target speed map as shown in FIG. 3 is stored.

Figure 3:
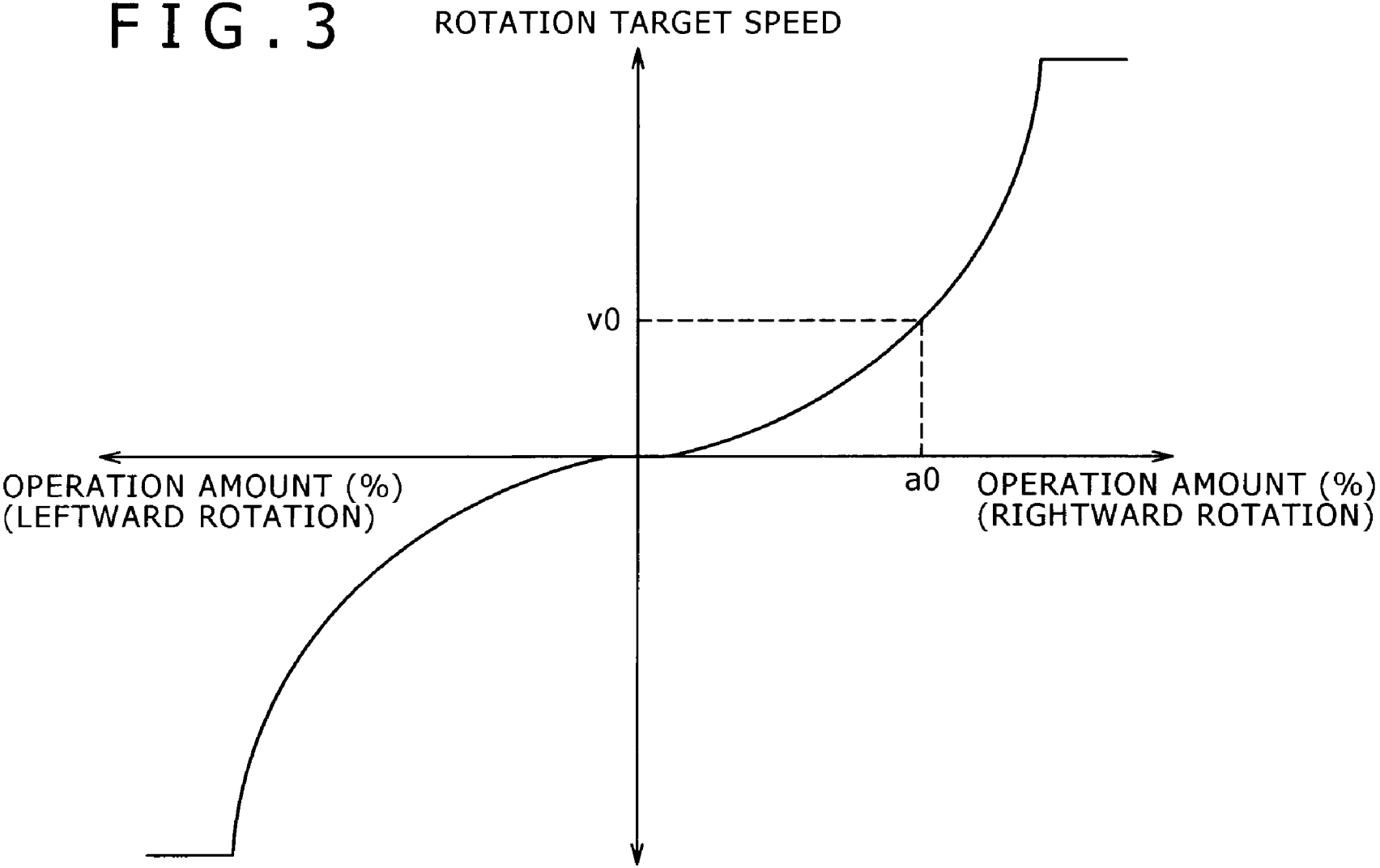
FIG. 3 is a map stored in a controller in FIG. 2 in which an operation amount of an operating lever and target speed are corresponded each other.

Specifically, the target speed map in FIG. 3 sets the target speed for both the operation directions (rightward rotation or leftward rotation direction) of the lever portion 25*a* of the operating lever 25 so that as the operation amount (titling angle) of the operating lever 25 is increased, a large amount of the target speed is selected. The target speed set in the above map is set as a curve without a radical increase/decrease so as to smoothly increase/decrease in accordance with an increase/decrease in the operation amount of the operating lever 25.

Figure 4:
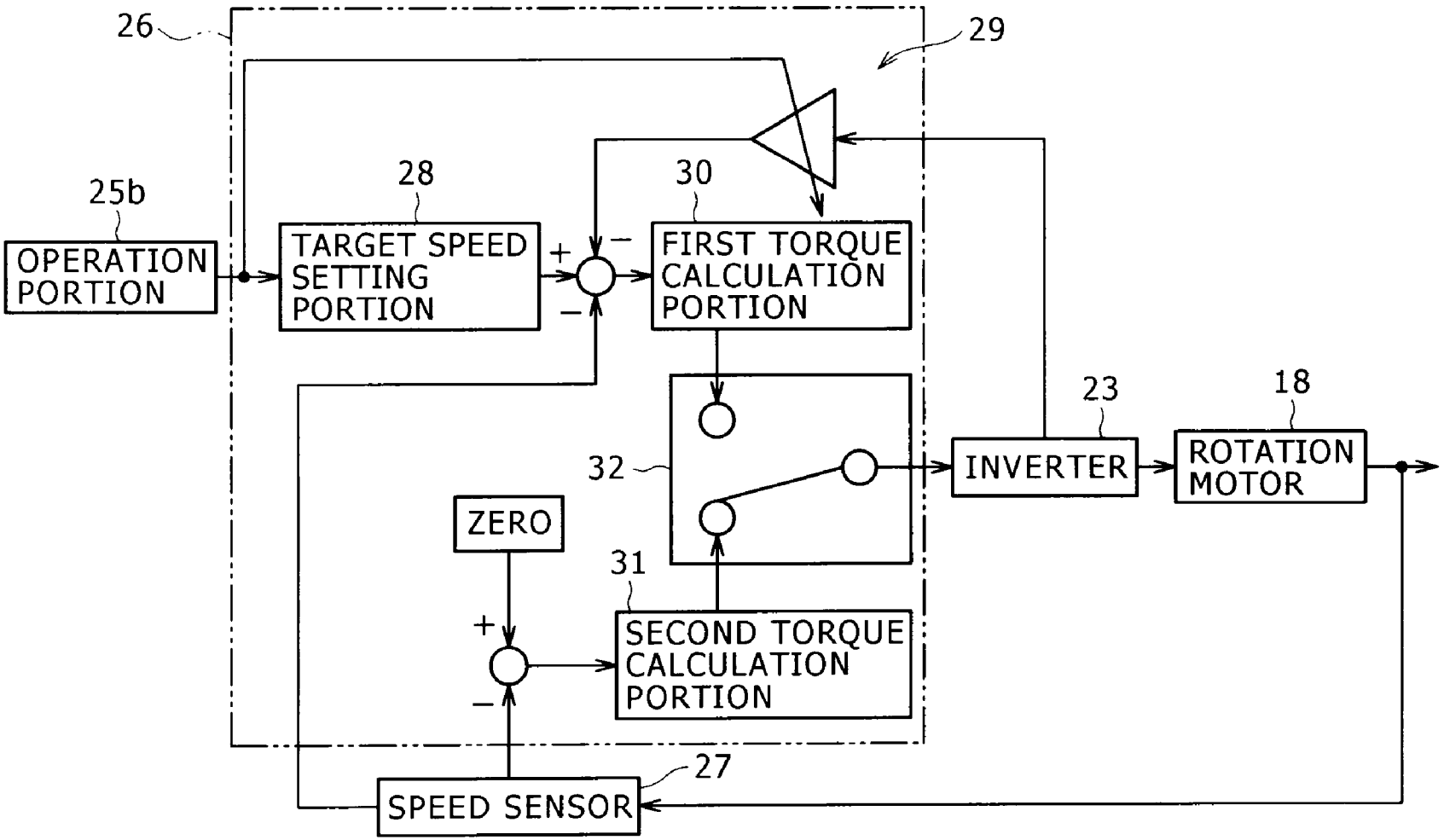
FIG. 4 is a block diagram showing an electrical configuration of the controller in FIG. 2.

FIG. 4 is a block diagram showing an electrical configuration of the controller in FIG. 2.

Referring to FIG. 4, the controller 26 is provided with a target speed setting portion 28 for setting the target speed on the basis of the above target speed map, a correction amount calculation portion 29 for calculating a correction amount of the target speed, a first torque calculation portion (first torque calculation means) 30 for calculating first target torque on the basis of the target speed, the correction amount and actual speed, a second torque calculation portion (second torque calculation means) 31 for calculating second target torque to be given to the rotation motor 18 in order to make the speed detected by the speed sensor 27 zero (in the case where the detected speed is zero, in order to maintain the state), and a target torque setting portion (target torque setting means) 32 for setting the torque which has a larger absolute value in the same direction as the first target torque (in the rightward rotation direction or the leftward rotation direction) among the first target torque and the second target torque as the next target toque.

The target speed setting portion 28 specifies target speed v0 corresponding to an operation amount a0 of the operating lever 25 from the above target speed map (refer to FIG. 3).

The correction amount calculation portion 29 detects necessary torque t0 for rotating the rotation motor 18, the necessary torque t0 being changed in accordance with a working state of the excavator 1 at the present. Here, the "working state of the excavator 1" indicates a working state of the working attachment 4 (a working radius of the working attachment 4, existence or nonexistence of earth and sand within the bucket 7 at the time of working or the like), or a reaction force received at the time of working (a reaction force received at the time of a pressing work by the bucket 7, weight of the excavator 1 itself in a inclined ground or the like). Specifically, in the present embodiment, the correction amount calculation portion 29 utilizes the target torque outputted from the inverter 23 in the previous cycle as a correspondent to the necessary torque t0 of the rotation motor 18, and calculates a correction amount b0 following an expression 1 below on the basis of the necessary torque t0 and the operation amount a0 of the operation portion 25*b*.

$$b0=t0^2\times\{G0+G1\times(1-a0\times0.01)\} \quad \text{(Expression 1)}$$

Here, G0 and G1 are control gain respectively, and correspond to intercept and a gradient when the operation amount a0 of the operation portion 25*b* serves as a variable. That is, the control gain G0 regulates a maximum value of the torque to be restricted. As the above control gain G0 is increased, a value of the target torque to be calculated at the end is decreased. Meanwhile, the control gain G1 regulates a ratio of increase/decrease in the torque to be restricted in accordance with a change of the operation amount a0 of the operating lever 25. By adjusting the above control gain G0 and G1, it is possible to obtain an effect corresponding to bleed-off in a hydraulic rotation system.

It should be noted that in the present embodiment, the target torque in the previous cycle is utilized as a correspondent to the necessary torque t0 of the rotation motor 18. However, on the basis of the target torque in the previous cycle and the speed of the rotation motor 18 detected by the speed sensor 27, actual necessary torque of the rotation motor 18 may be calculated.

As shown in an expression 2 below, the correction amount b0 calculated by the correction amount calculation portion 29 and actual speed v1 of the rotation motor 18 detected by the speed sensor 27 are subtracted from the target speed v0 so as to calculate a speed deviation |v.

$$v=v0-b0-v1 \quad \text{(Expression 2)}$$

The first torque calculation portion 30 calculates first target torque t1 following an expression 3 below on the basis of the speed deviation |v.

$$t1=G2\times|v+G3\times\int(|v)dt \quad \text{(Expression 3)}$$

Here, G2 and G3 are proportional gain and integral gain respectively which are preliminarily set.

Meanwhile, when an operation position of the lever portion 25*a* of the operating lever 25 is within the neutral range mentioned above, the second torque calculation portion 31 calculates second target torque t2 to be given to the rotation motor 18 in order to make the actual speed v1 of the rotation motor 18 detected by the speed sensor 27 zero following an expression 4 below.

$$t2=G4\times(0-v1)+G5\times\int(0-v1)dt \quad \text{(Expression 4)}$$

Here, G4 and G5 are proportional gain and integral gain respectively which are preliminarily set.

The target torque setting portion 32 sets the torque which has a larger absolute value in the same direction as the first target torque t1 (hereinafter, a description will be given taking the rightward rotation direction as the "positive" direction and the leftward rotation direction as the "negative" direction) among the first target torque t1 and the second target torque t2 as the next target toque.

Hereinafter, a description will be given to processing executed by the controller 26 with reference to FIGS. 4 and 5.

When the processing is started, firstly, the target speed v0 corresponding to the operation amount a0 of the operating lever 25 is specified on the basis of the map (refer to FIG. 3) (Step S1).

Next, the speed v1 of the rotation motor 18 is detected by the speed sensor 27 (Step S2), and the second target torque t2 is calculated following the above expression 4 on the basis of the speed v1 (Step S3).

The correction amount b0 is calculated following the above expression 1, and by utilizing the correction amount b0 and the speed v1, the speed deviation |v is calculated following the above expression 2 (Step S4).

Next, by using the speed deviation |v, the first target torque t1 is calculated following the above expression 3 (Step S5), and it is determined whether or not the first target torque t1 is in the positive direction (rightward rotation direction) (Step S6).

Here, in the case where the first target torque t1 is in the positive direction (rightward rotation direction) (YES in Step S6), the first target torque t1 and the second target torque t2 are compared to each other (Step S7), and the torque which has a larger absolute value in the positive direction among the first target torque t1 and the second target torque t2 is set as the next target toque (Steps S8 and S9). Then, the target torque set as mentioned above is outputted to the inverter 23 (Step S15) and the processing is finished.

Meanwhile, in the case where the first target torque t1 is not in the positive direction (NO in Step S6), it is determined whether or not the first target torque t1 is in the negative direction (leftward rotation direction) (Step S10).

Here, in the case where the first target torque t1 is in the negative direction (leftward rotation direction) (YES in Step S10), the first target torque t1 and the second target torque t2 are compared to each other (Step S11), and the torque which has a larger absolute value in the negative direction, that is, a smaller value in consideration to positive and negative, among the first target torque t1 and the second target torque t2 is set as the next target toque (Steps S12 and S13). Then, the target torque set as mentioned above is outputted to the inverter 23 (Step S15) and the processing is finished.

Further, in the case where it is determined that the first target torque t1 is in neither the positive direction nor the negative direction in Steps S6 and S10 (NO in Steps S6 and S10), that is, in the case where there is a need for maintaining the upper rotating body 3 on the spot, the second target torque t2 is set as the next target torque (Step S14), then, the target torque set as mentioned above is outputted to the inverter 23 (Step S15) and the processing is finished.

By performing the processing mentioned above, as shown in FIG. 6, it is possible to perform torque control in accordance with the operation of the operating lever 25.

Figure 6:
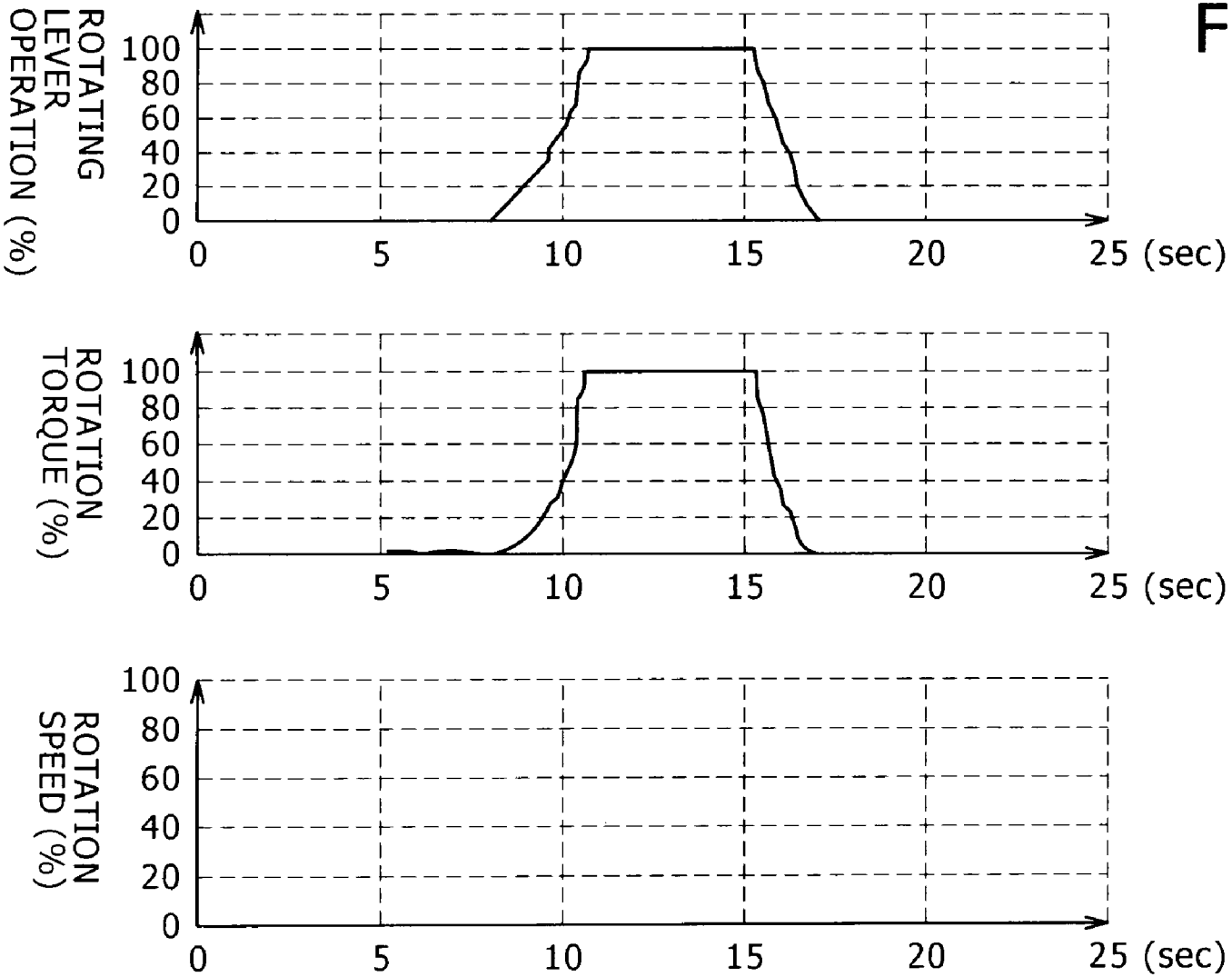
FIG. 6 shows an operation state of the operating lever, rotation torque, and rotation speed respectively, in the case where the operating lever is operated in a state that a bucket of the excavator is pressed down to the ground.

FIG. 6 shows an operation state of the operating lever 25 (rotating lever operation), rotation torque, and rotation speed respectively, in the case where the operating lever 25 is operated in a state that the bucket 7 of the excavator 1 is pressed down to the ground.

Figure 7:
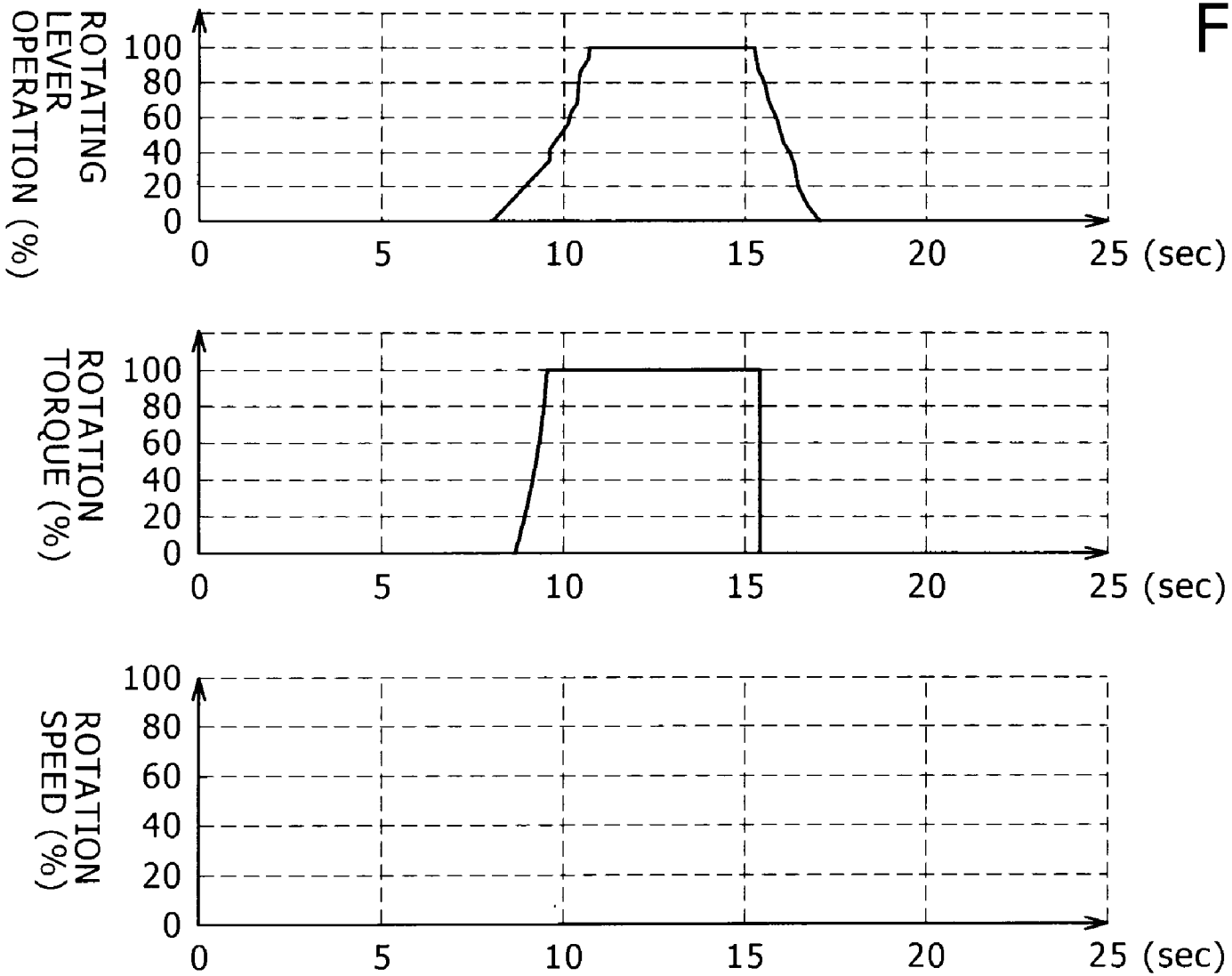
FIG. 7 is a view corresponding to FIG. 6 in the case where necessary torque t0 is not taken into consideration.
Figure 8:
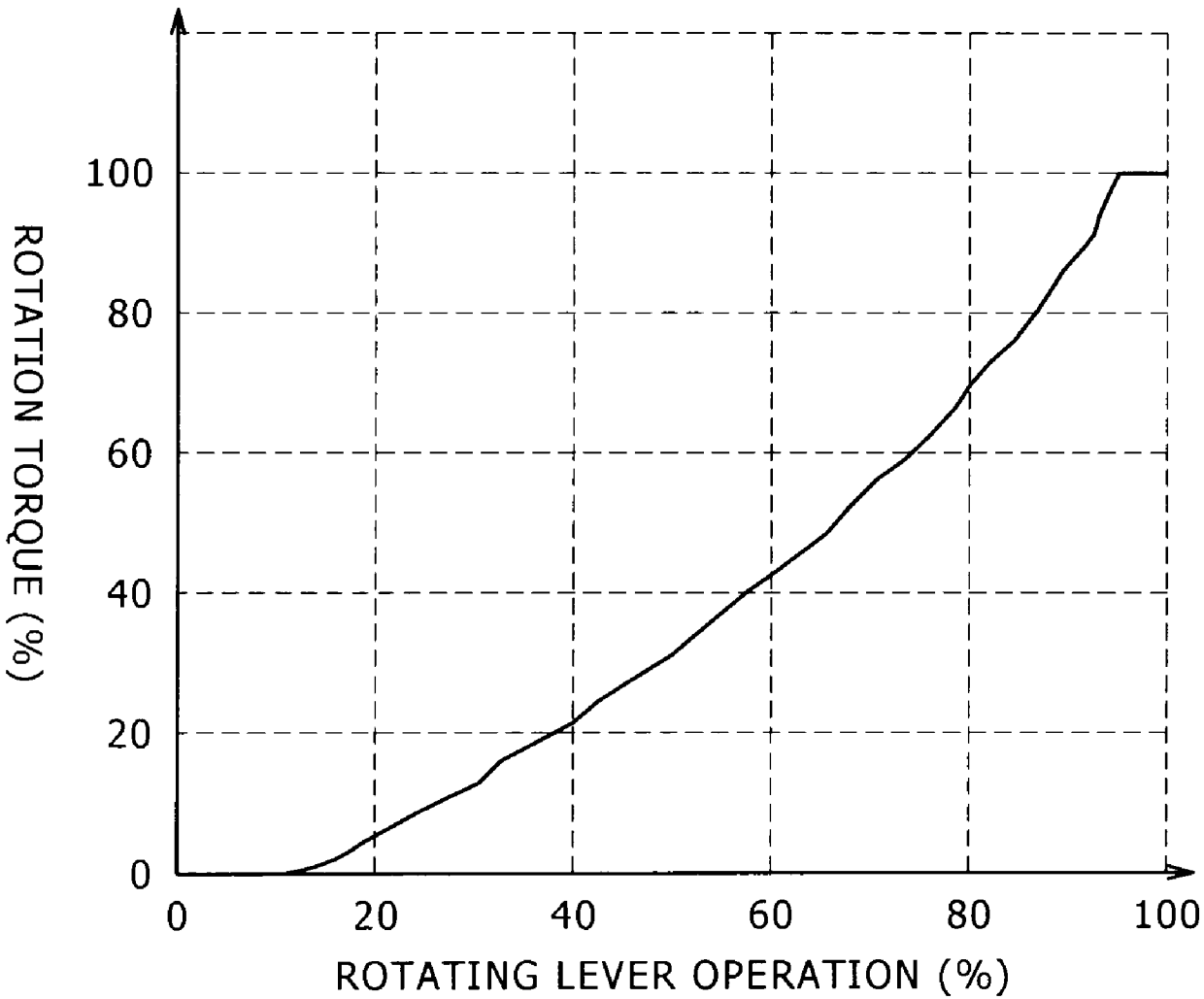
FIG. 8 is a graph showing a relation between the operation amount of the operating lever and the rotation torque in a state of FIG. 6.

That is, FIG. 6 shows a state that the operating lever 25 is operated in a state that the bucket 7 is pressed down to the ground so that the upper rotating body 3 cannot be rotated. In such a case, when PID control is performed without consideration to the necessary torque t0 as in the related art, the target speed is increased as increasing the operating amount of the operating lever 25 while the actual speed remains zero. Therefore, the speed deviation is remarkably increased, and as shown in a middle view of FIG. 7, there is a fear that the torque is radically increased so as to generate shock. However, in the above embodiment, by decreasing the speed deviation |v for the correction amount b0 on the basis of the necessary torque t0 of the rotation motor 18, as shown in a middle view of FIG. 6, it is possible to generate rotation torque in accordance with the operation of the operating lever 25. The above can also be understood by FIG. 8 showing a relation between the operation amount of the operating lever 25 and the rotation torque. It should be noted that as well as FIG. 6, FIG. 8 shows the rotation torque in a state that the bucket 7 is pressed down to the ground so that the upper rotating body 3 cannot be rotated.

Figure 9:
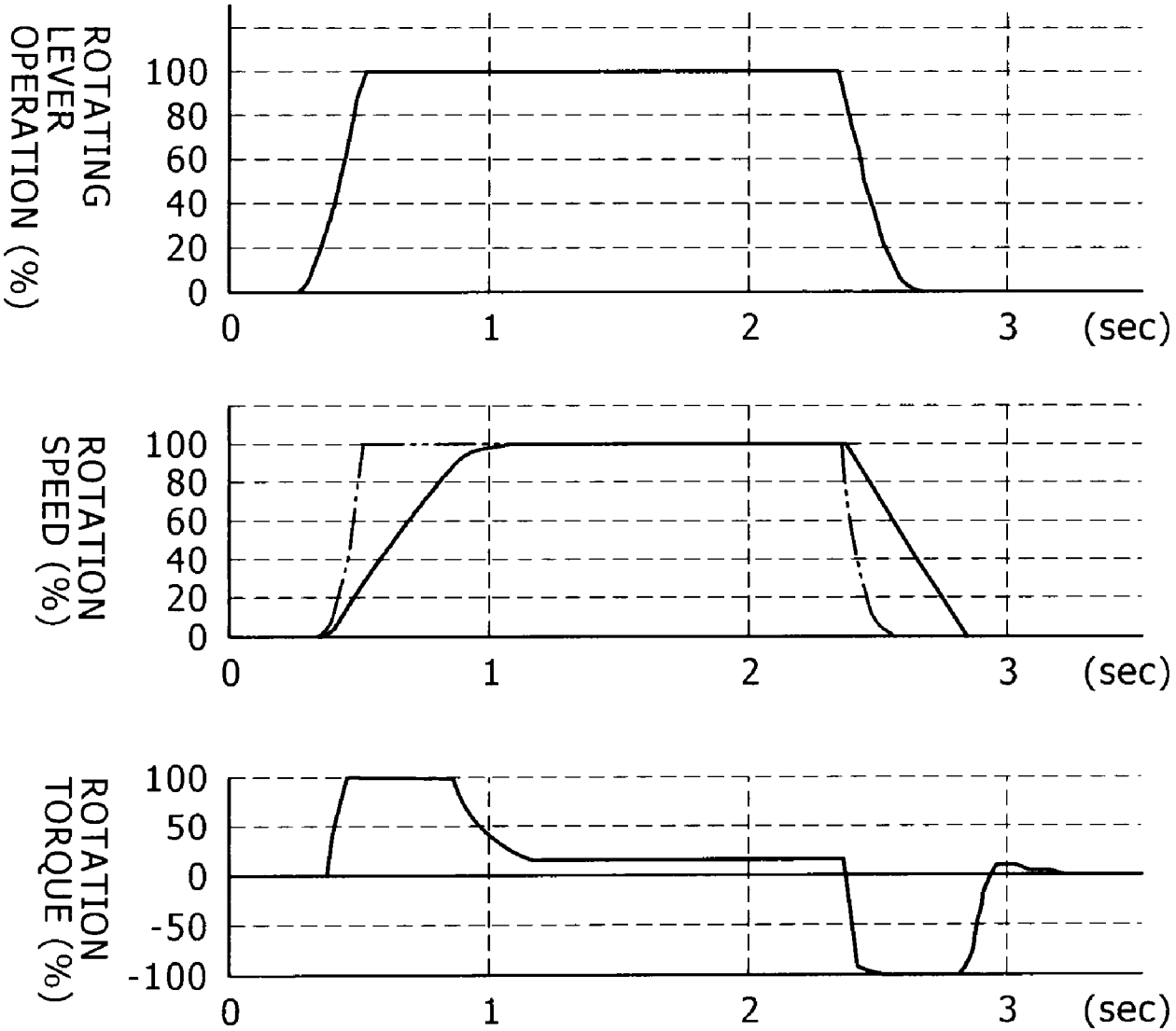
FIG. 9 shows the operation amount of the operating lever, the rotation speed, and the rotation torque respectively, in the case where the necessary torque generated in an upper rotating body is relatively small.

FIG. 9 shows the operation amount of the operating lever, the rotation speed, and the rotation torque respectively, in the case where the necessary torque t0 generated in the upper rotating body is relatively small.

Figure 10:
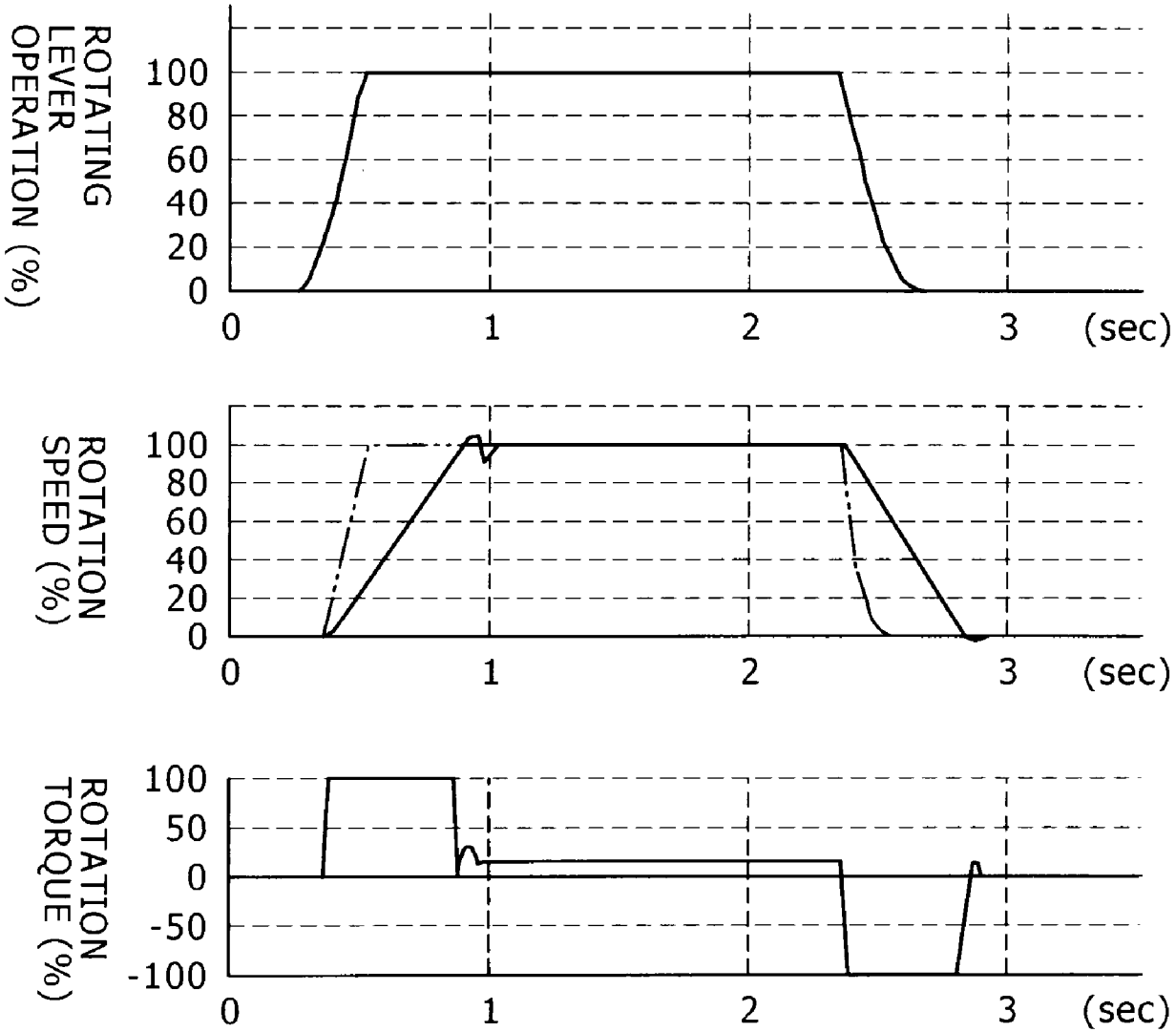
FIG. 10 is a view corresponding to FIG. 9 in the case where the necessary torque t0 is not taken into consideration.

As shown in the above expression 1, the correction amount b0 comes close to zero as decreasing the necessary torque t0. Therefore, in the case where the necessary torque t0 is small, it is possible to perform speed control without consideration to the necessary torque t0 as in the related art. For reference, FIG. 10 shows the operation amount of the operating lever, the rotation speed, and the rotation torque in the case where the necessary torque t0 is not taken into consideration. It should be noted that a solid line in a view of the rotation speed shows actual rotation speed, and a double chain line shows the target speed corresponding to the operation amount of the operating lever 25.

Further, in the above embodiment, as mentioned above, the torque which has a larger absolute value in the same direction as the first target torque t1 among the first target torque t1 and the second target torque t2 is set as the next target torque. Therefore, it is possible to smoothly change the torque. Hereinafter, a description will be given to the above point in comparison to the conventional configuration.

Figure 11:
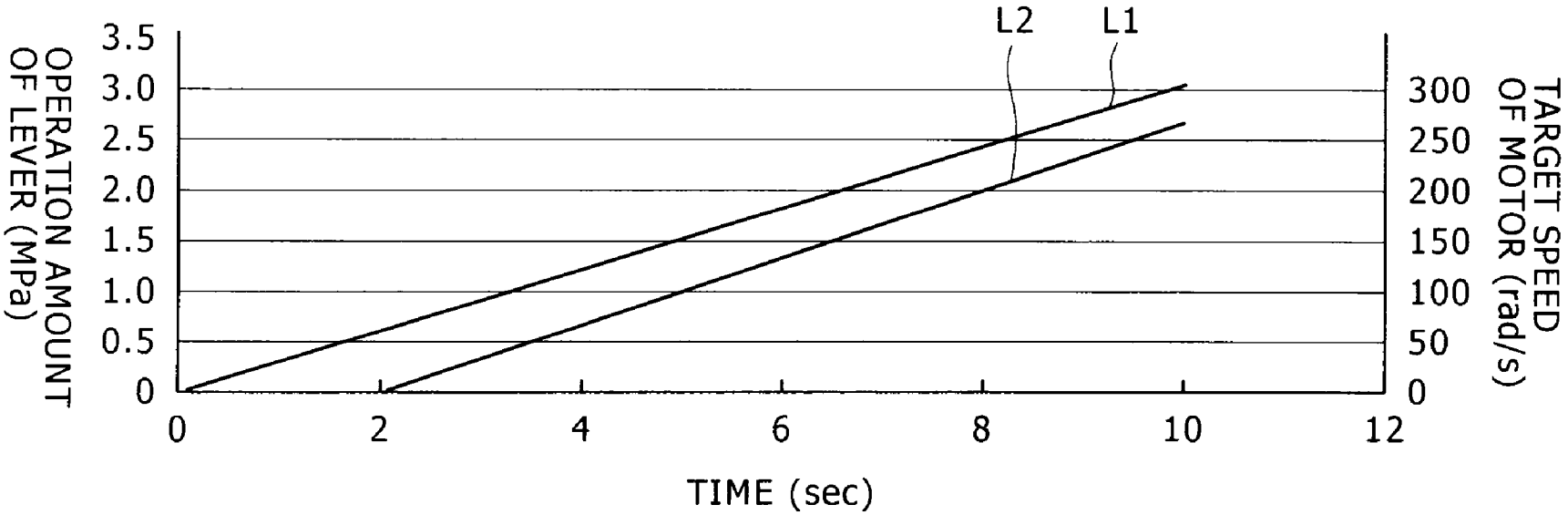
FIG. 11 is a graph showing a relation between the operation amount of the operating lever and the target speed of a motor.

Hereinafter, a description will be given to a case where the target speed of the rotation motor 18 changes as shown by L2 in accordance with an increase in an operation amount L1 of the operating lever 25 over time as shown in FIG. 11. It should be noted that as is clear from the fact that the line L2 comes up in a range of 2 second, an operation range of the operating lever 25 within a range from 0 to 2 second is a dead zone (play).

Figure 12A:
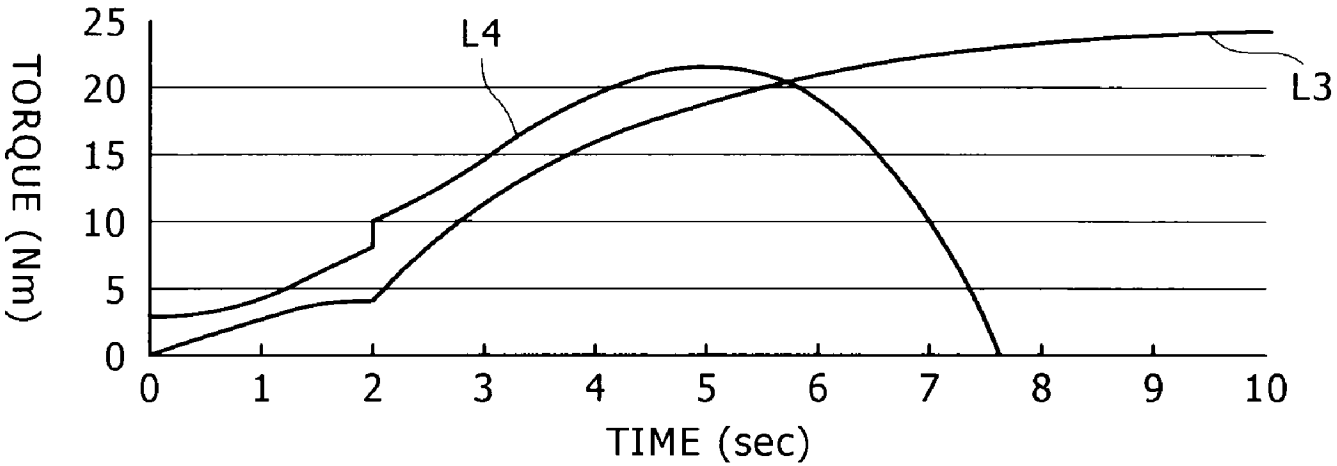
FIGS. 12A and 12B are graphs showing control according to the related art.
Figure 12B:
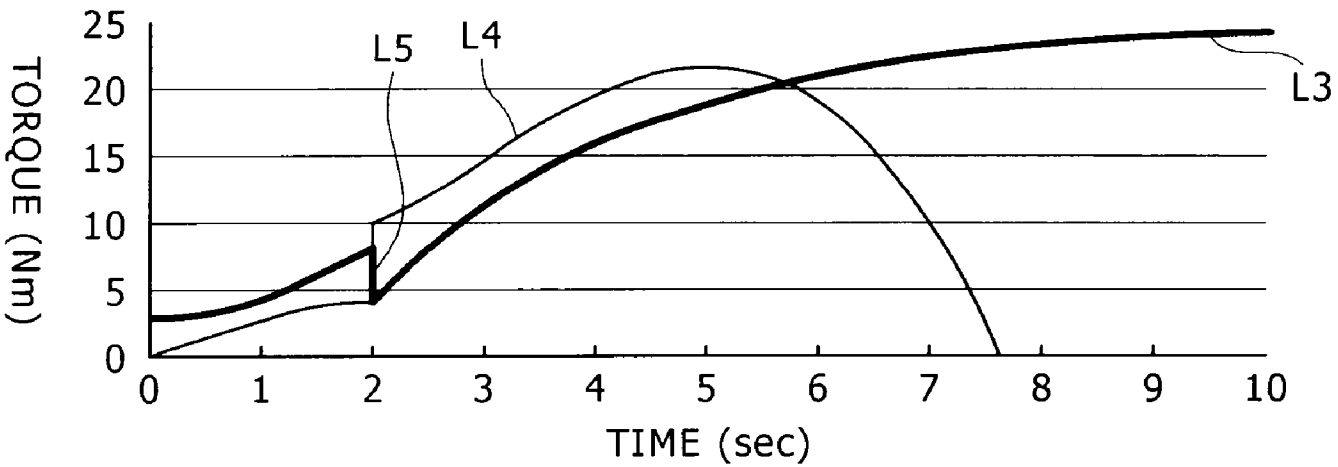

For example, in the related art disclosed in Japanese Patent Laid-Open No. 2003-328398, while the speed proportional control (PID control) is performed with the operation amount of the operating lever within the range of the dead zone, the torque control is performed in the case where the operation amount of the operating lever exceeds the range of the dead zone. That is, as shown in FIG. 12A, in the case where torque transition L3 at the time of performing the speed proportional control and torque transition L4 for maintaining the upper rotating body on the spot are taken into consideration, as the operation amount of the operating lever is gradually increased, the torque changes following the torque transition L4 within the range of the dead zone from 0 to 2 second as shown in FIG. 12B. However, when the operating lever is operated exceeding the range of the dead zone, the torque control following the torque transition L3 is performed from the above point. Therefore, when the operating lever is operated until an end of the dead zone, a discontinuous part L5 for supplementing the torque transition L3 and the torque transition L4 is generated.

Figure 13A:
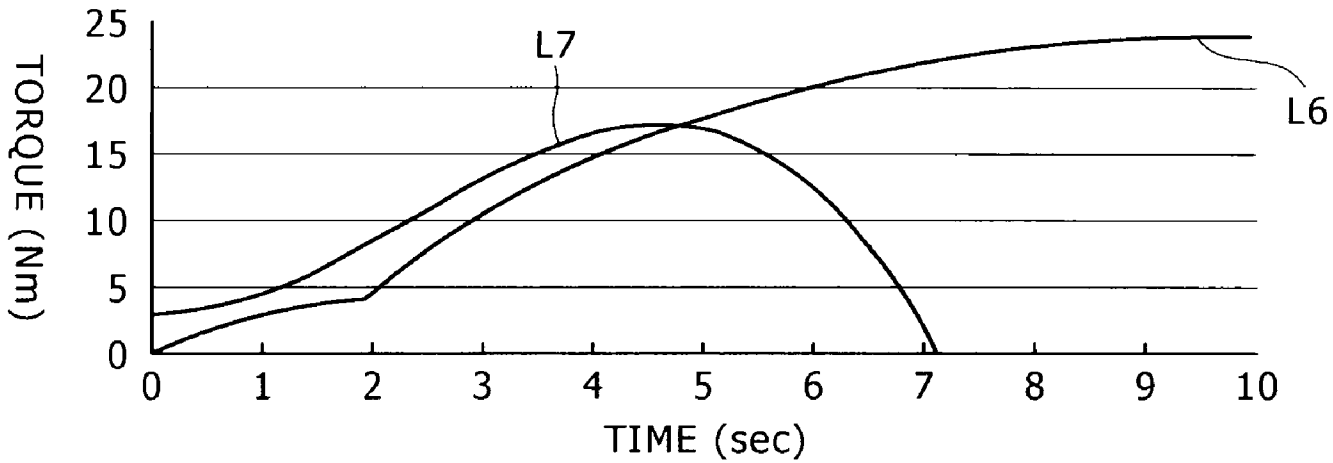
FIGS. 13A and 13B are graphs showing control according to the present invention.
Figure 13B:
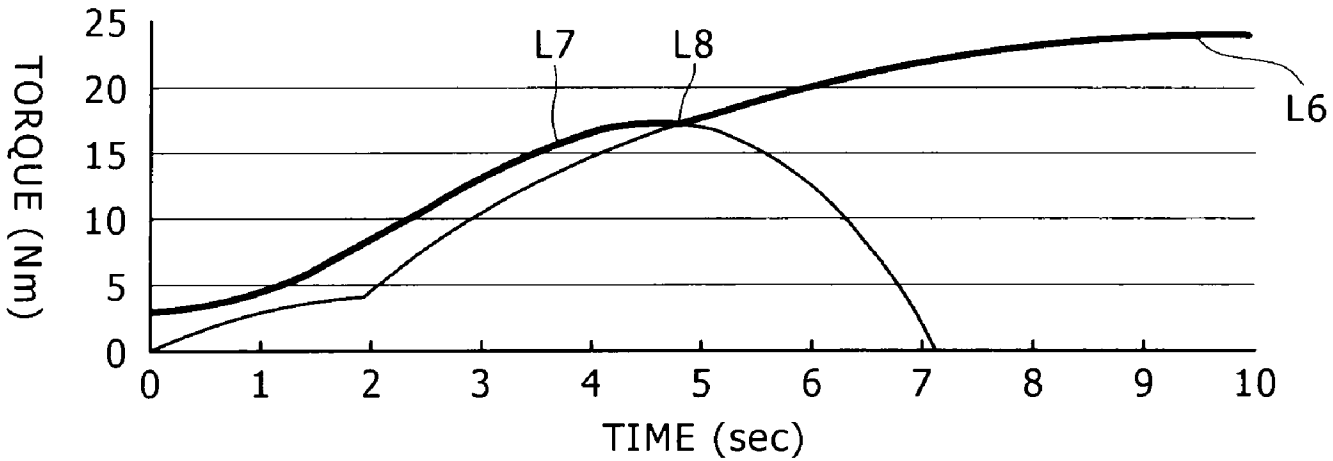

Meanwhile, in the above embodiment, as shown in FIG. 13A, first target torque L6 at the time of performing the speed proportional control and second target torque L7 for maintaining the upper rotating body 3 on the spot are always compared to each other so as to select the torque which has a larger value among the first target torque L6 and the second target torque L7. Therefore, as shown in FIG. 13B, in the above embodiment, irrespective of the operation amount of the operating lever 25, it is possible to continuously switch between the first target torque L6 and the second target torque L7 taking the intersection point L8 between the first target torque L6 and the second target torque L7 as a border. Consequently, according to the present embodiment, it is possible to smoothly and stably perform the control.

As mentioned above, according to the above embodiment, on the basis of the actual speed detected by the speed sensor 27, the second target torque t2 is set. Therefore, even in the case where a work is performed in an environment in which the working state is changed each time, it is possible to specify spot-maintenance torque (second target torque t2) which is suitable for the working state at the present. That is, in accordance with the working state of the working attachment 4 (the working radius of the working attachment 4, the existence or the nonexistence of the earth and sand within the bucket 7 at the time of working or the like), the external force received at the time of working (the external force received at the time of the pressing work by the bucket 7, the weight of the working machine itself in the inclined ground or the like) or the like, the spot-maintenance torque is changed each time. However, according to the above embodiment, it is possible to surely prevent the adverse movement of the upper rotating body even in such a case.

Figure 5:
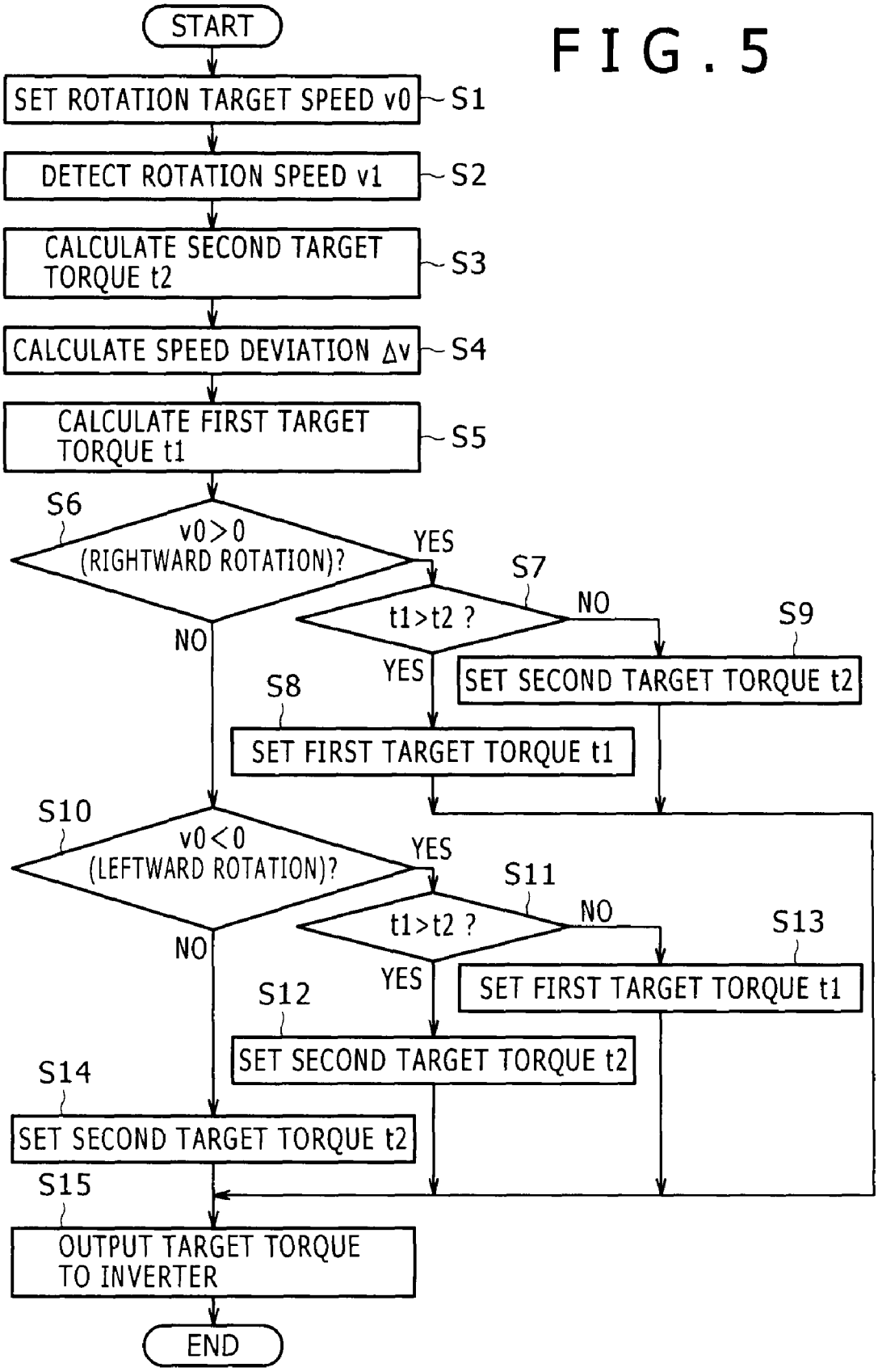
FIG. 5 is a flowchart showing processing executed by the controller in FIG. 2.

Further, in the above embodiment, the larger value is selected between the second target torque t2 calculated as above and the first target torque t1 calculated on the basis of the operation amount of the operating lever 25 (Steps S6 to S14 in FIG. 5). Therefore, when examining transitioning lines L6 and L7 of the first target torque t1 and the second target torque t2 (refer to FIG. 13), the torque to be selected is changed taking the intersection point L8 of the lines L6 and L7 as a border. As mentioned above, according to the above embodiment, unlike the related art in which control systems are switched taking a specific element other than the torque as a border, the first target torque t1 and the second target torque t2 are always compared to each other in terms of an amount thereof so as to adapt the larger torque. Therefore, it is possible to suppress the discontinuous change of the torque.

It should be noted that in the above embodiment, the description is given to the configuration in which the preliminarily set values of the gain G2, G3, G4 and G5 in the expression 3 and the expression 4 are fixed. However, it is possible to provide gain change means for changing the gain G2 to G5 in the controller 26.

In such a way, it is possible to adjust the gain G2 to G5 by the gain change means. Therefore, when the working radius of the working attachment 4 is large and when the inertia moment of the rotating body is large as in the work in the inclined ground or the like, it is possible to surely prevent the adverse movement by setting the gain G2 to G5 into larger gain. Meanwhile, in the case where the rotation pressing work by the bucket 7 or the like is performed, it is possible to fine-adjust the torque in accordance with the operation of the operating lever 25 by changing the gain into smaller gain.

In the above embodiment, an amount of the target torque of the rotation motor 18 is adjusted in accordance with the necessary torque t0 for rotating the upper rotating body 3 (target torque in the previous cycle), the necessary torque t0 being changed in accordance with the working state of the upper rotating body 3. Therefore, it is possible to effectively suppress the generation of the shock.

That is, in the excavator 1, the working state thereof such as the working state of the working attachment 4 (the working radius of the working attachment 4, according to the existence or the nonexistence of earth and sand within the bucket 7 at the time of working or the like), or the external force received at the time of working (the reaction force received at the time of the pressing work by the bucket 7, the weight of the excavator 1 itself in the inclined ground or the like), the necessary torque t0 is changed. Therefore, as the necessary torque t0 is increased, the speed deviation |v between the target speed and the actual speed v1 detected by the speed detection means tends to be increased. However, in the above embodiment, it is possible to prevent the increase in the speed deviation |v.

Specifically, in the above embodiment, the correction amount b0 which is increased as increasing the necessary torque t0 is calculated and the correction amount b0 is subtracted from the target speed v0 which is already set. Therefore, it is possible to decrease the speed deviation |v between the new target speed (v0−b0) and the actual speed v1 detected by the speed sensor 27.

Therefore, according to the above embodiment, since it is possible to decrease the speed deviation |v as increasing the necessary torque t0, it is possible to suppress the generation of the shock.

As in the above embodiment, with the configuration in which the correction amount b0 which is decreased as increasing the operation amount a0 of the operating lever 25 is calculated, it is possible to suppress an excessive decrease in the target speed after correction as the operation amount a0 of the operating lever 25 is increased. Therefore, it is possible to ease an uncomfortable feeling of an operator.

As in the above embodiment, with the configuration in which the target torque set in the previous cycle is utilized as the necessary torque t0 used in the present cycle, it is possible to simplify the processing in comparison to the case where the necessary torque t0 of the upper rotating body 3 is actually calculated.

That is, all the change of the necessary torque t0 of the upper rotating body 3 is reflected to load torque (target torque) of the rotation motor 18. Therefore, by calculating the correction value b0 in accordance with an increase/decrease in the load torque so as to calculate the target torque, it is possible to calculate the target torque corresponding to the change of the necessary torque t0.

As in the above embodiment, with the configuration provided with the target torque setting portion 32 for setting the torque which has a larger absolute value in the same direction as the first target torque t1 among the first target torque t1 and the second target torque t2 as the target toque, it is possible to surely prevent the generation of the "adverse movement" in which the upper rotating body 3 is rotated in the adverse direction due to lack of the torque in the case where the rotation is started towards the up side in the inclined ground and in the case where the rotation is started towards the upwind side in strong winds.

Further, in the case where the rotation is stopped in the inclined ground, the torque of the rotation motor 18 is always an amount which is proportional with gravity. Therefore, it is possible to prevent that the control torque is overcome by the gravity so as to adversely move the upper rotating body 3 to the down side.

Although the invention has been described with reference to the preferred embodiments in the attached figures, it is noted that equivalents may be employed and substitutions made herein without departing from the scope of the invention as recited in the claims.

We claim:

1. A rotation control device of working machine having a main body, a rotating body rotatably mounted on said main body and a working attachment provided in said rotating body so as to be raised and lowered, comprising:

an electric motor for rotating and driving said rotating body;

operation means for receiving an input operation of a drive instruction to said electric motor;

operation amount detection means for detecting an operation amount of said operation means;

speed detection means for detecting rotation speed of said electric motor; and control means for setting target speed of said electric motor on the basis of the operation amount detected by said operation amount detection means, setting target torque on the basis of a speed deviation between the target speed and the speed detected by said speed detection means, and operating said electric motor in accordance with the target torque, wherein said control means is provided with correction means for calculating a correction amount which is increased as increasing necessary torque for rotating said rotating body, said necessary torque being changed in accordance with a working state of said rotating body, and subtracting the correction amount from the target speed so as to make new target speed.

2. The rotation control device of working machine according to claim 1, wherein said correction means calculates a correction amount which is decreased as increasing the operation amount of said operation means.

3. The rotation control device of working machine according to claim 1, wherein said control means is formed so as to set the target torque for a predetermined cycle, and said correction means utilizes the target torque set in the previous cycle as a correspondent to the necessary torque of said rotating body to be used for the present cycle, and calculates the correction amount.

4. A working machine, comprising:

a main body;

a rotating body rotatably mounted on said main body; and the rotation control device according to claim 1.

5. A rotation control device of working machine having a main body, a rotating body rotatably mounted on said main body and a working attachment provided in said rotating body so as to be raised and lowered, comprising:

an electric motor for rotating and driving said rotating body;

operation means for receiving an input operation of a drive instruction to said electric motor;

operation amount detection means for detecting an operation amount of said operation means;

speed detection means for detecting rotation speed of said electric motor; and control means for setting first target torque for driving said electric motor at target speed corresponding to the operation amount detected by said operation amount detection means, setting second target torque for maintaining said rotating body on the spot on the basis of actual speed detected by said speed detection means, and operating said electric motor in accordance with torque which has a larger absolute value in the same direction as the first target torque among the first target torque and the second target torque.

6. The rotation control device of working machine according to claim 5, wherein said control means is provided with target speed setting means for setting the target speed on the basis of the operation amount detected by said operation amount detection means, first torque calculation means for calculating the first target torque on the basis of a speed deviation between the target speed and actual speed detected by said speed detection means, and target torque setting means for setting the torque which has a larger absolute value in the same direction as the first target torque among the first target torque and the second target torque as the next target torque.

7. The rotation control device of working machine according to claim 6, wherein said control means is further provided with second torque calculation means for calculating torque to be given to said electric motor in order to make the actual speed zero as the second target torque.

8. The rotation control device of working machine according to claim 7, wherein said first torque calculation means and said second torque calculation means are adapted to calculate the first target torque and the second target torque on the basis of expressions having a proportional term and an integral term respectively, and said control means is provided with gain change means capable of changing an amount of gain by which the proportional term and the integral term are multiplied.

9. A working machine, comprising:

a main body;

a rotating body rotatably mounted on said main body; and the rotation control device according to claim 5.

* * * * *